US006061027A

United States Patent [19]

Legay et al.

[11] Patent Number: 6,061,027

[45] Date of Patent: May 9, 2000

[54] RADIATING STRUCTURE

[75] Inventors: Hervé Legay, Plaisance du Touch; Frédéric Croq, Tournefeuille; Michel Pauchet, Plaisance du Touch, all of France

[73] Assignee: Alcatel, Paris, France

[21] Appl. No.: 09/143,657

[22] Filed: Aug. 31, 1998

[30] Foreign Application Priority Data

Sep. 1, 1997 [FR] France ..... 97 10842

[51] Int. Cl.[7] ..... H01Q 1/38

[52] U.S. Cl. ..... 343/700 MS; 343/846; 343/848

[58] Field of Search ..... 343/700 MS, 846, 343/848; H01Q 1/38

[56] References Cited

U.S. PATENT DOCUMENTS

| | | | |
|---|---|---|---|
| 4,623,893 | 11/1986 | Sabban | 343/700 MS |
| 4,847,626 | 7/1989 | Kahler et al. | 343/700 MS |
| 4,857,938 | 8/1989 | Tsukamoto et al. | 343/700 MS |
| 5,005,019 | 4/1991 | Zaghloul et al. | 343/700 MS |
| 5,233,364 | 8/1993 | Lefeuvre et al. | 343/789 |
| 5,278,569 | 1/1994 | Ohta et al. | 343/700 MS |

FOREIGN PATENT DOCUMENTS

| | | |
|---|---|---|
| 0 627 783 A1 | 12/1994 | European Pat. Off. . |
| WO 96/39728 | 12/1996 | WIPO . |

OTHER PUBLICATIONS

Lee et al, Circular Polarisation Characteristics of Parasitic Microstrip Antennas, Antennas and Propagation Society Symposium, 1991, Digest, No. 1, p. 310–313.

*Primary Examiner*—Don Wong
*Assistant Examiner*—Shih-Chao Chen
*Attorney, Agent, or Firm*—Sughrue, Mion, Zinn, Macpeak & Seas, PLLC

[57] ABSTRACT

A radiating structure, or antenna, includes an exciter patch which receives an excitation signal and a plurality of secondary patches which radiate the waves received from the exciter patch. The structure includes a reflective surface in the vicinity of the exciter patch and the secondary patches constitute semi-reflective surfaces. The combination is such that the waves radiated by the secondary patches are substantially in phase. The distance between the reflective surface and the secondary patches is substantially equal to half the wavelength to be transmitted. The structure maintains the purity of circular polarization over a wide angular sector.

14 Claims, 2 Drawing Sheets

RADIATING STRUCTURE

BACKGROUND OF THE INVENTION

1. Field of the Invention

The invention concerns an antenna, or radiating structure, comprising an exciter patch associated with a set of radiating secondary patches.

2. Description of the Prior Art

Printed patch antennas are routinely used because their manufacturing cost is low and they are light in weight and small in size, which is particularly useful in space applications. They are generally made by etching or lithographically printing conductive patches onto dielectric substrates.

An antenna of the above kind is described in European patent application N° 627 783 the title of which in translation is "Variable directive gain multilayer radiating structure". The above patent application describes an antenna in which the secondary patches are disposed in one or more planes parallel to the plane of the exciter patch.

The above antenna is very suitable for radiating in a range of directive gains from 9 dbi through 13 dbi, a range which it would be difficult to cover using individual radiators.

It has been found that antennas of the above type procure circular polarization of good quality, i.e. very low ellipticity on the axis of the antenna, perpendicular to the planes of the patches. On the other hand, the ellipticity increases significantly for directions inclined to the axis of the antenna.

The invention provides a radiating structure that maintains the purity of circular polarization over a wide angular sector.

It results from the observation that in prior art antennas the quality of polarization is degraded for inclined directions because of the nature of the coupling between the exciter patch and the radiating patches, this coupling being of the electromagnetic or proximity type.

SUMMARY OF THE INVENTION

In the antenna of the invention a reflective surface is provided around the exciter patch and the secondary patches constitute semi-reflective surfaces for the excitation wave, the position of the secondary patches relative to each other and relative to the reflective surface being such that the transmitted waves are in phase.

In other words, the secondary patches are not excited by electromagnetic coupling but in dichroic mode.

It has been found that this mode of excitation maintains good quality of circular polarization over a wide angular sector with inclinations to the axis up to 50° or more.

The quality of the radiated signal depends of course on the signal applied to the exciter patch.

In one embodiment the emitting patch is in (or near) a first plane constituting the reflective surface, or ground plane, and the secondary patches are at a distance equal to approximately half the wavelength ($\lambda$) to be transmitted. Under the above conditions, a wave emitted by the exciter patch towards a secondary patch travels a distance of one half-wavelength. The corresponding beam is partly transmitted by the secondary patch, and therefore radiated outwards, and partly reflected. The reflected beam is directed towards the reflective surface from which it returns to the same secondary patch or to another secondary patch from which it is transmitted and thus radiated. The beam reflected at a secondary patch and which returns to another secondary patch therefore travels one wavelength. Accordingly, the two rays transmitted are in phase.

The total aperture of the radiated beam depends on the reflection coefficient of the secondary patches. The greater the reflection coefficient the greater the aperture. The part of the beam at the greatest distance from the central part, where the exciter patch is located, is subject to the greatest number of reflections and therefore most attenuated by those reflections.

It has been found that it is possible to excite a circular polarization signal with a single port on the exciter patch provided that the exciter patch has a non-circular shape.

In one embodiment the primary and secondary patches are disposed in a conductive cavity in order to orient the radiation emitted and/or to limit coupling with other nearby elements. In this case it has been found that reflection of the excitation waves at the walls of the cavity degrades the quality of polarization. This is why, in this embodiment, at least the peripheral secondary patches have a shape and an orientation such that the circular polarization is re-established. For example, the peripheral secondary patches are all substantially the same shape with substantially the same dimensions and are elongate along a particular axis, with a radial or non-radial orientation, and the angle between the axes of two successive patches corresponds to the angle the apex of which is the center around which the secondary patches are disposed and the sides of which are the straight lines joining the apex to the centers of the patches concerned.

The above orientations of the peripheral secondary patches increase the directive gain of the antenna because the illumination of the secondary patches is made uniform.

It has been found that all embodiments of the invention emit waves over a wide band of frequencies.

To benefit from the good quality of circular polarization and from the wide bandwidth, it is preferable to take particular precautions. If the secondary patches are in a plane parallel to the plane of the reflective surface and at a distance of $\lambda/2$ from that surface, the reflected beams being inclined to the normal to those planes, the electrical path length travelled by the beam between two secondary patches is greater than the wavelength $\lambda$. The phase-shift is negligible for one reflection but troublesome phase-shifts can result in the case of multiple reflections. This is a particular problem with large aperture antennas, i.e. antennas for which the peripheral secondary patches receive a signal which is the result of several reflections.

To overcome this drawback the invention provides means for compensating the phase-shift.

A first embodiment of this compensation consists in making the resonant frequency of each secondary patch dependent on its distance from the center around which the secondary patches are disposed: the greater the distance to the center the higher the resonant frequency.

When the patches are circular the variation is obtained, for example, either by giving the secondary patches at the greatest distances from the center a smaller diameter than the central patches or by giving the patches an annular shape, the inside diameter of the central patches being greater than the inside diameter of the peripheral secondary patches.

A second embodiment of phase-shift compensation consists in modulating the distance between the reflective surface and the surface of the secondary patches, for example so that the distance between the secondary patches and the reflective surface decreases as the distance from the secondary patches to the center increases.

Other features and advantages of the invention will become apparent from the description of certain embodiments of the invention given with reference to the accompanying drawings.

DETAILED DESCRIPTION OF THE PREFERRED EMBODIMENTS

Figure 1:
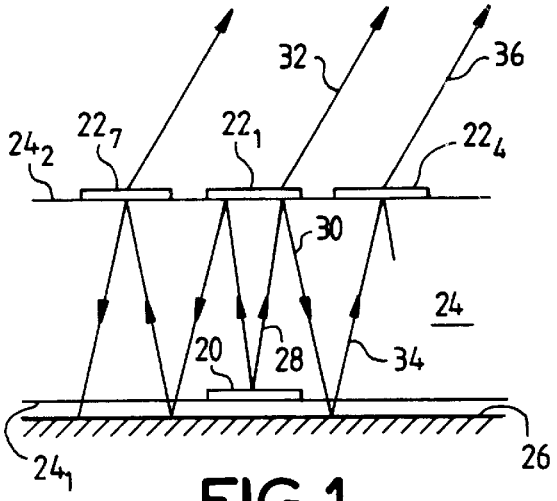
FIG. 1 is a diagrammatic sectional view of an antenna of the invention.
Figure 2:
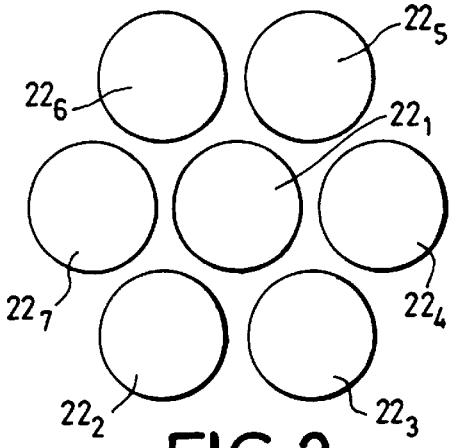
FIG. 2 is a top view of the antenna from FIG. 1.
Figure 3:
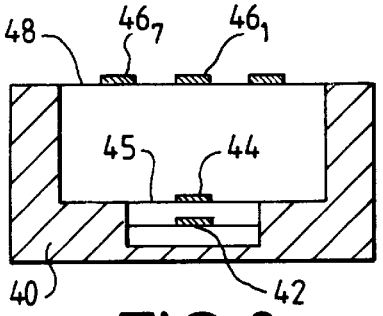
FIG. 3 is a sectional view of another embodiment of an antenna of the invention.

Refer firstly to FIGS. 1 and 2.

The antenna shown in those figures is adapted to emit waves in the microwave band, around a center frequency of 8 GHz.

It includes an exciter patch 20 and secondary patches $\mathbf{22}_1$ through $\mathbf{22}_7$.

The patch 20 is deposited on one face $\mathbf{24}_1$ of a dielectric substrate 24 and the patches $\mathbf{22}_1$ through $\mathbf{22}_7$ are disposed on the opposite face $\mathbf{24}_2$ of the dielectric 24. All the patches are circular metallic deposits which in this example are all the same diameter.

The patch $\mathbf{22}_1$ is aligned with the patch 20, i.e. the centers of the patches 20 and $\mathbf{22}_1$ are on the same normal to the plane of the parallel faces $\mathbf{24}_1$ and $\mathbf{24}_2$.

The other secondary patches $\mathbf{22}_2$ through $\mathbf{22}_7$ are regularly distributed around the center patch $\mathbf{22}_1$.

In accordance with one important aspect of the invention the distance between the faces $\mathbf{24}_1$ and $\mathbf{24}_2$ is substantially equal to one half-wavelength $\lambda/2$.

The face $\mathbf{24}_1$ is at a small distance from the conductive face 26 forming a ground plane.

The features of the secondary patches $\mathbf{22}_1$ through $\mathbf{22}_7$ are chosen so that the patches are semi-reflective, i.e. a beam 28 received by the secondary patch is partly reflected by the secondary patch concerned, as a beam 30, and partly transmitted, as a beam 32.

Accordingly, the antenna works in the following manner:

The beam 30 reflected by the central secondary patch $\mathbf{22}_1$ is reflected again at the ground plane 26 as a beam 34 towards a peripheral secondary patch $\mathbf{22}_4$. The patch $\mathbf{22}_4$ partially transmits the beam as a beam 36. The beam 32 transmitted by the central patch $\mathbf{22}_1$ is parallel to the beam 36 transmitted by the patch $\mathbf{22}_4$ and the beams 32 and 36 are practically in phase because the path length travelled by the beams 30 and 34 is substantially equal to $\lambda$.

This feature conserves the purity of circular or linear polarization over a wide angular sector, up to an inclination of approximately 50° to the normal two faces $\mathbf{24}_1$ and $\mathbf{24}_2$.

It will be shown later than the excitation signal applied to the patch 20 can be applied to a single port thereof provided that the patch has a non-circular shape, with an axis inclined at approximately 45° to the direction of the incident current, for example.

As indicated hereinabove, the secondary patches $\mathbf{22}_1$ through $\mathbf{22}_7$ are semi-reflective. "Semi-reflective" does not necessarily mean having properties such that 50% of the energy is reflected and 50% of the energy is transmitted. The reflection coefficient can be modulated in accordance with requirements, in particular the required aperture of the antenna. In particular, the larger the number of secondary patches in succession in the radial direction the higher the reflection coefficient. At each reflection at a secondary patch the energy of the beam is reduced in proportion to the reflection coefficient. A high reflection coefficient will therefore be needed for there to be sufficient remaining energy in the case of beams reflected several times at the secondary patches. Note that the reflection coefficient at the ground plane is practically 100%.

Of course, the larger the number of successive patches in the radial direction the larger the radius of the radiated beam (FIG. 2).

In the example described hereinabove a dielectric substrate 24 is used. As an alternative to this the exciter patch and the secondary patches can be deposited onto different substrates separated by vacuum or by air.

Refer now to FIGS. 3 through 6.

In this embodiment the antenna is accommodated in a metallic cavity 40. The cavity orients the emitted beam and limits coupling with other nearby antennas, for example identical or similar antennas forming an array in which the antenna shown is located.

In this example there are two exciter patches 42 and 44. The first exciter patch 42 in the lower position (i.e. at the greater distance from the surface of the secondary patches) receives the excitation signal and the second exciter patch 44 is coupled electromagnetically or by the proximity effect to the lower patch. The secondary patches $\mathbf{46}_1$ through $\mathbf{46}_7$ are in a plane 48 at a distance of approximately one half-wavelength from the plane 45 of the patch 44.

Figure 4:
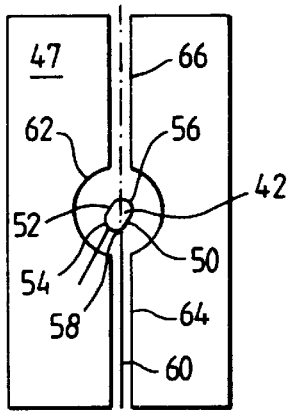
FIGS. 4, 5 and 6 are diagrammatic representations of the patches of the antenna from FIG. 3.
Figure 5:
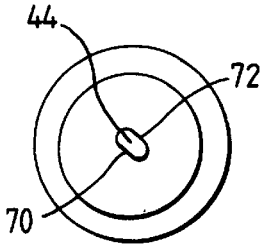

As shown in FIG. 4, the patch 42 is a metallic deposit on a substrate 47 and its shape is a semi-curvilinear rectangle with two parallel rectilinear sides 50 and 52 and two curvilinear sides 54 and 56 which are arcs of a common circle.

The apex 58 common to the sides 50 and 54 is connected to a conductor 60 which also consists of a metallic deposit on the substrate 47.

The conductor 60 has the same direction as the diagonal of the curvilinear rectangle that terminates at the apex 58. The angle between this diagonal and the sides 50 and 52 is approximately 30°.

A conductive deposit on the substrate 47 is interrupted by a circle 62 around the patch 42 and by two channels 64 and 66 in the same direction as the diagonal, the channel 64 being provided for the conductor 60.

The patch 44 (FIG. 5) has a similar shape to the patch 42. Its dimensions are slightly less than those of the patch 42. Its center is aligned with the center of the lower patch. The orientation of the rectilinear sides 70 and 72 of the patch 44 differs from the orientation of the rectilinear sides of the patch 42: the inclination of the sides 70 and 72 to the direction of the conductor 60 is approximately 45°.

The elongate, or chamfered, shape of the patches 42 and 44 means that the patches can be excited by a circular polarization wave with a single port (apex 58, FIG. 4) without degrading the quality of circular polarization after excitation of the secondary patches $\mathbf{46}_1$ through $\mathbf{46}_7$.

Figure 6:
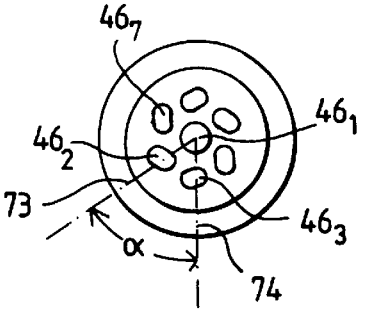

The central secondary patch $\mathbf{46}_1$ aligned with the patch 44 is circular in shape and the peripheral secondary patches $\mathbf{46}_2$ through $46_7$ have an elongate shape, similar to that of the patches 42 and 44, i.e. a semi-curvilinear rectangular shape (FIG. 6).

The rectilinear sides of the peripheral patches that are diametrally opposed have the same orientation. Two successive peripheral patches have rectilinear sides of different orientations. The angle between the rectilinear sides of the successive peripheral patches is practically equal to the angle $\alpha$at the center (60° in this example) formed by the straight lines 73 and 74 joining the centers of the corresponding patches $46_2$ and $46_3$ to the center of the center patch $46_1$.

Thus all the peripheral patches have the same inclination to their radial direction (the direction joining the center of the patch to the center of the center patch).

The double resonator formed by the patches 42 and 44 increases the bandwidth of the antenna compared to a single patch.

The shape and the relative orientation of the patches 42 and 44 means that they can be excited by a circularly polarized wave with a single port 58 (FIG. 4).

Finally, the shape, the disposition and the orientation of the secondary patches $46_2$ through $46_7$ compensates the loss of polarization induced by the conductive cavity 40.

This increases the directive gain because of the uniform illumination.

Figure 7:
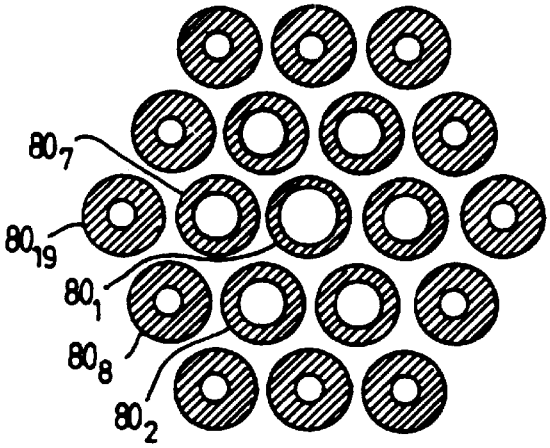
FIG. 7 shows secondary patches for another embodiment of the invention.
Figure 8:
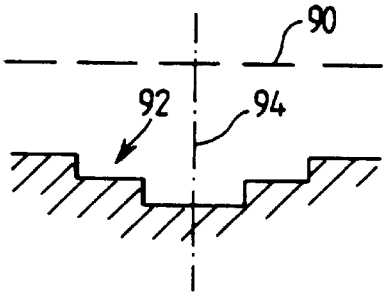
FIG. 8 is a diagrammatic representation of a variant antenna of the invention.
Figure 9:
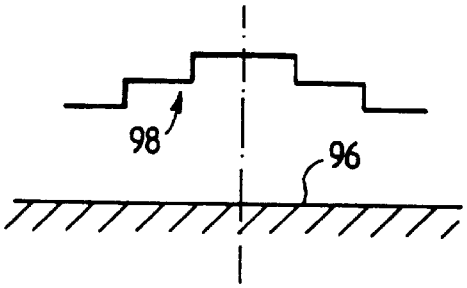
FIG. 9 is a diagram similar to that of FIG. 8 for a further variant.

The embodiment shown in FIGS. 7 through 9 concerns a large aperture antenna, i.e. an antenna having a large number of secondary patches and with a large radial size from the central patch $80_1$.

In the example shown there are 19 secondary patches $80_1$ through $80_{19}$ comprising a center patch $80_1$ surrounded by six intermediate patches $80_2$ through $80_7$ surrounded by 12 peripheral patches $80_8$ through $80_{19}$.

A beam emitted by the exciter patch (not shown) toward the center secondary patch $80_1$ is reflected by the center patch $80_1$ towards the ground plane and the beam is reflected at the ground plane towards an intermediate patch. At the intermediate patch the beam is again reflected towards the ground plane and finally towards a peripheral patch. It will be remembered that such multiple reflections necessitate a relatively high reflection coefficient at the secondary patches for the beam reaching the peripheral secondary patches to have an intensity that is not too low in comparison to the beam transmitted by the center patch.

Because the reflected beams are not strictly perpendicular to the plane of the patches the electrical path length travelled by the beam between two adjacent secondary patches is greater than one wavelength. The resulting phase-shift is only slightly significant from one secondary patch to an adjacent patch but becomes more significant when the phase shifts add. This produces problematical secondary lobes.

Phase correction means are provided to overcome this problem.

In phase correction means of a first category a lower resonant frequency is employed at the center than at the periphery. In other words, the wavelength is matched to the electrical path lengths travelled so that the waves emitted by all the secondary patches are in phase.

Variation of the resonant frequencies is favorable to a wide bandwidth.

In the example shown in FIG. 7 all the patches have substantially the same outside diameter and an annular shape but the diameter of the central opening depends on the position of the patch. The diameter of the opening of the patch $80_1$ is greater than the diameter of the opening of the intermediate patches $80_2$ through $80_7$ and the diameter of the opening of the peripheral patches $80_8$ through $80_{19}$ is the smallest.

In a variant (not shown) the resonant frequency is varied by varying the outside diameter of the patches, the center patch having the largest diameter.

In phase shift correction means of a second category the distance between the reflective surface and the semi-reflective patches is varied from the center towards the periphery.

In the FIG. 8 example the secondary patches are in a plane 90 and the reflective surface 92 features circular steps around the axis 94. The greater the distance of these steps from the axis 94 the nearer they are to the plane 90.

In the example shown in FIG. 9 the reflective surface 96 is plane and the secondary patches are on circular steps 98. The central patch is at the greatest distance from the plane 96 and the peripheral patches are nearest the plane 96.

In a variant, inclined surfaces are provided instead of steps. It is also possible to provide inclined surfaces or steps for the reflective surface and also for the secondary patches.

There is claimed:

1. A radiating structure, or antenna, including an exciter patch adapted to receive an excitation signal, a plurality of secondary patches adapted to radiate the waves received from said exciter patch and a reflective surface in the vicinity of said exciter patch and wherein said secondary patches constitute semi-reflective surfaces, the combination being such that waves radiated by said secondary patches are substantially in phase.

2. The structure claimed in claim 1 wherein the distance between said exciter patch and said reflective surface, on the one hand, and said secondary patches, on the other hand, is substantially equal to half the wavelength to be transmitted.

3. The structure claimed in claim 2 wherein said secondary patches are disposed concentrically and have a reflection coefficient that increases with the number of secondary patches extending in a radial direction.

4. The structure claimed in claim 1 wherein said plurality of secondary patches includes a central patch and at least one multiplicity of peripheral patches around said central patch.

5. The structure claimed in claim 1 wherein said exciter patch has an elongate shape in one direction and said exciter patch is fed with a circular polarization wave via a single port.

6. The structure claimed in claim 1 wherein said exciter patch receives excitation energy via another patch separated from said exciter patch by a distance that is small in comparison to the distance between said exciter patch and said secondary patches.

7. The structure as claimed in claim 1 including a conductive cavity accommodating said exciter patch and said secondary patches.

8. The structure claimed in claim 7 wherein said secondary patches include a multiplicity of peripheral patches with shapes and orientations such that they compensate the loss of polarization induced by said conductive cavity.

9. The structure claimed in claim 8 wherein said peripheral patches are elongate in a direction inclined to the radial direction joining the center of said patches to the center of the set of secondary patches, the inclination of all said peripheral patches relative to their radial direction being the same.

10. The structure claimed in claim 1 wherein said secondary patches are disposed around a center with at least one set of patches at a first distance from said center and at least one multiplicity of peripheral patches at a greater distance from said center, the resonant frequency of the patch or patches nearest said center being lower than the resonant frequency of the patches at a greater distance from said center.

11. The structure claimed in claim 10 wherein said patches are circular and the patches nearest the center have a larger outside diameter than the patches at a greater distance from the center.

12. The structure claimed in claim 10 wherein said patches are annular and all have substantially the same outside diameter, the inside diameter of the patches nearest said center being larger than the inside diameter of the patches at the greatest distance from said center.

13. The structure claimed in claim 1 wherein said secondary patches are disposed around a center and the distance between said secondary patches and said reflective surface decreases from said center towards the periphery.

14. The structure claimed in claim 13 wherein said reflective surface and/or the surface on which said secondary patches are disposed feature steps.

* * * * *